US006622700B2

(12) United States Patent
Lee et al.

(10) Patent No.: US 6,622,700 B2
(45) Date of Patent: Sep. 23, 2003

(54) INTEGRATED FUEL SYSTEM AND WIRING HARNESS

(75) Inventors: Ki-Ho Lee, Windsor (CA); Lisa Whaley, Wheatley (CA)

(73) Assignee: Siemens VDO Automotive, Inc., Chatham (CA)

( * ) Notice: Subject to any disclaimer, the term of this patent is extended or adjusted under 35 U.S.C. 154(b) by 0 days.

(21) Appl. No.: 09/978,407

(22) Filed: Oct. 16, 2001

(65) Prior Publication Data

US 2002/0046737 A1 Apr. 25, 2002

Related U.S. Application Data

(60) Provisional application No. 60/242,870, filed on Oct. 24, 2000.

(51) Int. Cl.[7] ..... F02M 37/04
(52) U.S. Cl. ..... 123/456; 123/469
(58) Field of Search ..... 123/456, 468–9, 123/470, 184.61

(56) References Cited

U.S. PATENT DOCUMENTS 4,966,120 A 10/1990 Itoh et al.
5,086,743 A * 2/1992 Hickey ..... 123/468
5,127,382 A 7/1992 Imoehl
5,168,857 A * 12/1992 Hickey ..... 123/468
5,568,798 A * 10/1996 Lorraine ..... 123/456
5,611,313 A * 3/1997 Ashcraft ..... 123/456
5,743,235 A * 4/1998 Lueder ..... 123/468
5,934,252 A 8/1999 Hafner et al.

FOREIGN PATENT DOCUMENTS

DE 197 57 347 A1 6/1998

* cited by examiner

*Primary Examiner*—Thomas N. Moulis

(57) ABSTRACT

A fuel injection system for an internal combustion engine is provided that includes a fuel injector having an injector housing with first and second opposing portions. An injector passage extends between the first and second portions. A valve is disposed in the injector passage for selectively permitting fuel to flow from the first portion to the second portion. A fuel rail having a fuel passage includes a first opening receiving the first portion with the injector passage and fluid communication with the fuel passage. An intake manifold has a second opening receiving the second portion. A polymer layer extends from the fuel rail and intake manifold about at least a portion of the fuel injector sealing the first and second portions respectively to the fuel rail and intake manifold for preventing fuel from leaking from the fuel injection system. The injector wiring may also be integrated into the fuel injection system. The fuel rail may include a cavity for receiving wires that are connected to electrical contacts extending from the injectors into the cavity. A plastic material may be molded into the cavity to enclose the wires from the outside environment.

19 Claims, 5 Drawing Sheets

INTEGRATED FUEL SYSTEM AND WIRING HARNESS

RELATED APPLICATIONS

This application claims priority to provisional application No. 60/242,870, filed Oct. 24, 2000.

BACKGROUND OF THE INVENTION

This invention relates to a fuel injection system for an internal combustion engine, and more particularly, the invention relates to an integrated fuel rail, fuel injector, and injector wires.

Modern internal combustion engines typically use fuel injectors to increase fuel efficiency and control over engine operation. Commonly, a fuel injector is used for each engine cylinder. The fuel injectors receive fuel from a fuel rail and are supported in an intake manifold. A valve in the injector meters fuel from the fuel rail into the engine cylinder at a desired time during the engine cycle.

A fuel injection system typically includes many components that must be assembled, which increases the likelihood of fuel permeating or leaking from the system. The fuel injectors may include an O-ring or seal at opposing ends that are received in the fuel rail and intake manifold. For a six-cylinder engine, up to twelve seals may be needed for the fuel injection system. Presently, there are very strict rules limiting the amount of hydrocarbons that may permeate from a vehicle. Each connection between components presents a potential for permeation of fuel in gaseous form. Furthermore, the fuel injection system is under relatively high pressures. As a result, there is an increased opportunity for fuel to leak past the seals. Therefore, what is needed is a fuel injection system that reduces the number of components and assembly required while improving the resistance to fuel permeation or leakage from the system.

SUMMARY OF THE INVENTION AND ADVANTAGES

The present invention provides a fuel injection system for an internal combustion engine that includes a fuel injector having an injector housing with first and second opposing portions. An injector passage extends between the first and second portions. A valve is disposed in the injector passage for selectively permitting fuel to flow from the first portion to the second portion. A fuel rail having a fuel passage includes a first opening receiving the first portion with the injector passage and fluid communication with the fuel passage. An intake manifold has a second opening receiving the second portion. A polymer layer extends from the fuel rail and intake manifold about at least a portion of the fuel injector sealing the first and second portions respectively to the fuel rail and intake manifold for preventing fuel from leaking from the fuel injection system. In this manner, an integrated intake manifold fuel rail and fuel injector may be provided that eliminates the numerous seals typically used and reduces the potential for fuel leakage.

The polymer layer may also form the fuel rail and intake manifold such that a separate fuel rail and intake manifold is not required. Alternatively, the polymer layer may form the fuel rail only and the fuel rail may be connected to the intake manifold thereby eliminating half of the seals typically required.

The injector wiring may also be integrated into the fuel injection system. The fuel rail may include a cavity for receiving wires that are connected to electrical contacts extending from the injectors into the cavity. A plastic material may be molded into the cavity to enclose the wires from the outside environment.

Accordingly, the above invention provides a fuel injection system reducing the number of components and assembly associated with construction of the fuel injection system while reducing the potential for fuel leakage.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
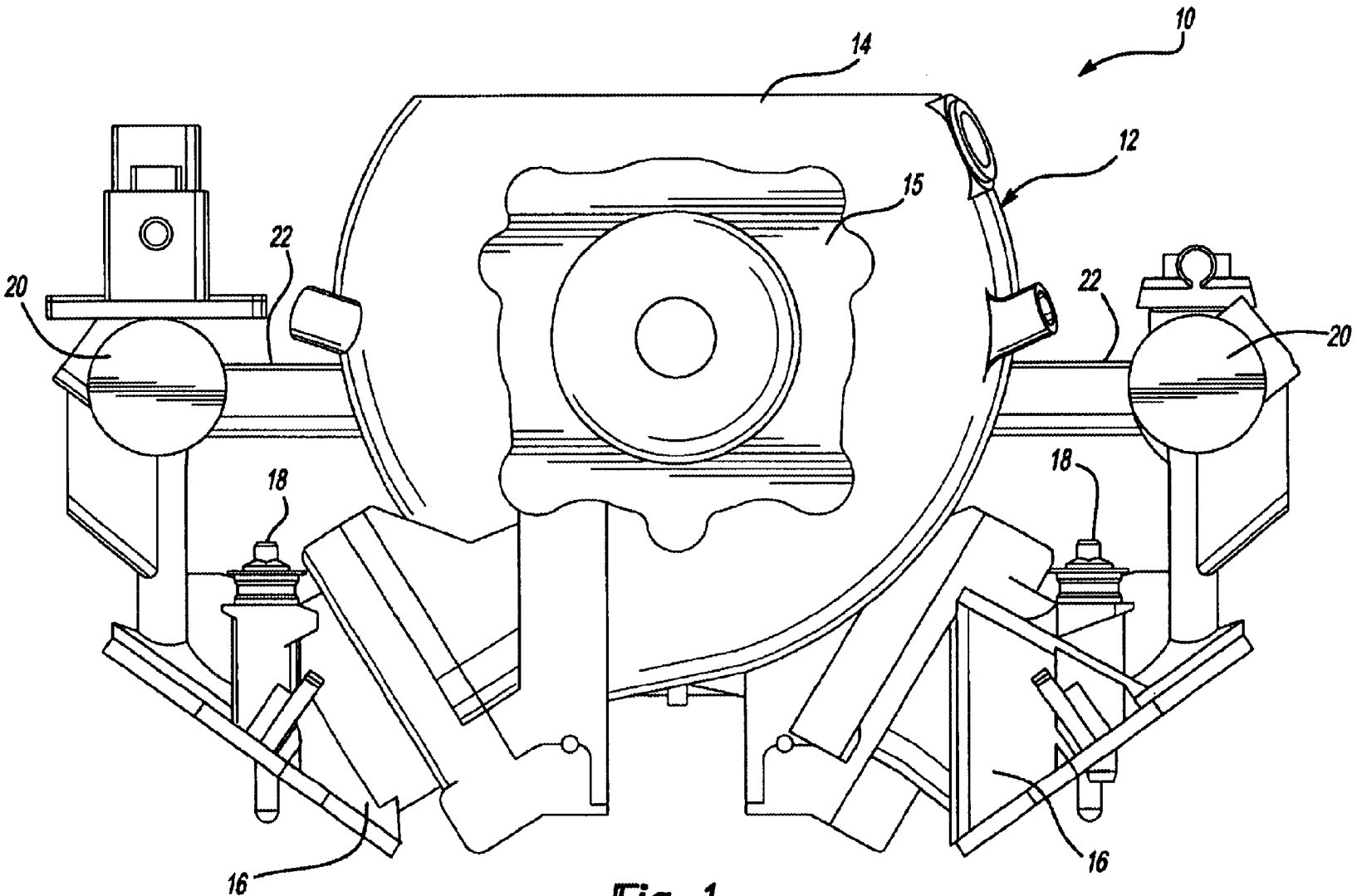
FIG. 1 is a front elevational view of a fuel injection system.

A fuel injection system 10 is shown in FIG. 1. The system 10 includes an intake manifold 12 which may be constructed from an upper intake manifold portion 14 and a lower intake manifold portion 16 secured to the upper portion 14. Two lower portions 16 are shown in FIG. 1 for a V-configuration engine. The upper intake manifold portion 14 has a plenum carrying air from a throttle body connected to a throttle body mount 15 to apertures, each of which correspond to a passageway connected to each of the engine cylinders.

Figure 2A:
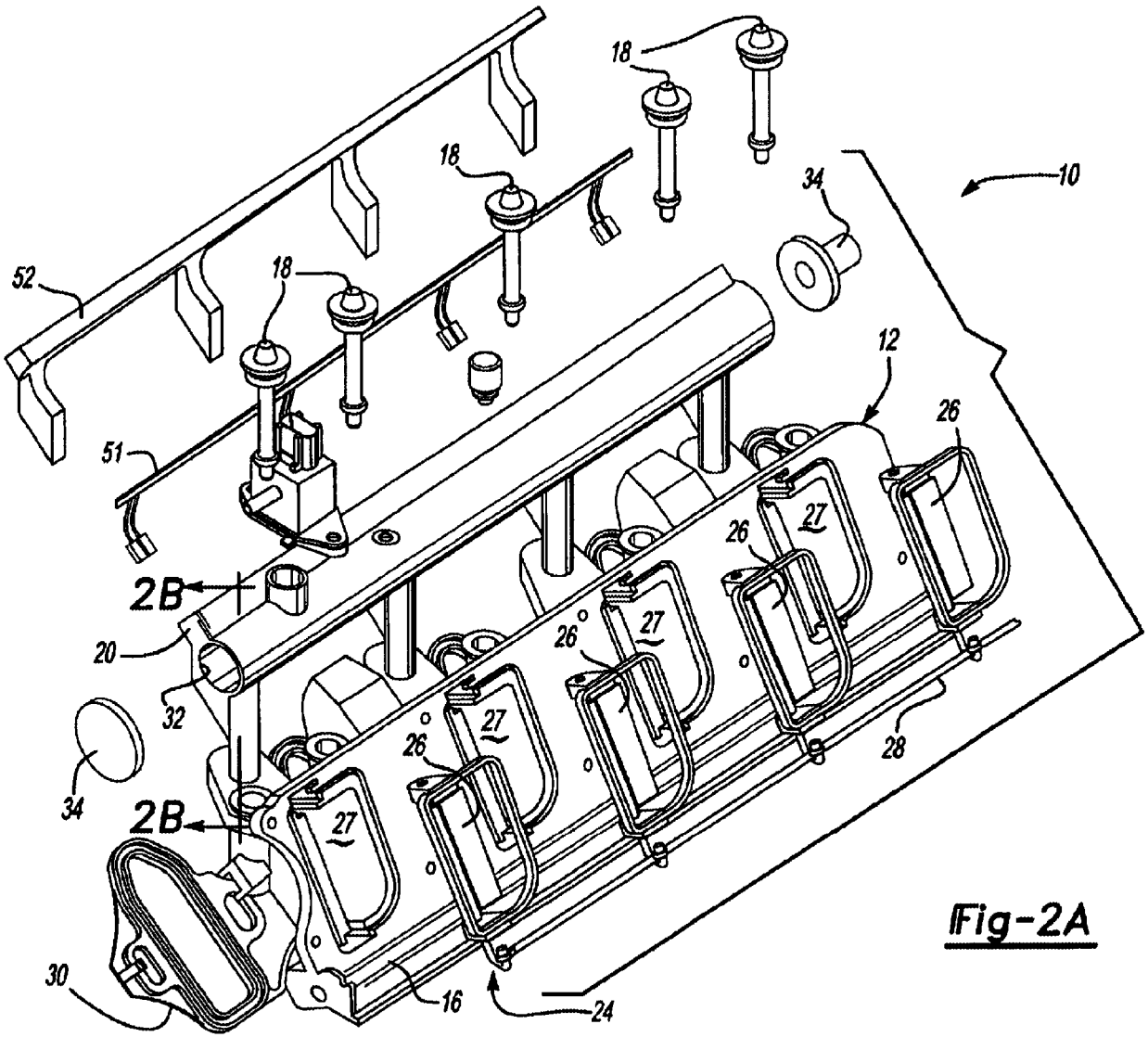
FIG. 2A is an exploded view of a lower intake manifold of the present invention.

The fuel injection system is attached to the cylinder heads fasteners 18. The fuel rails 20 transport fuel from a fuel cross over 22 to each of the passageways to provide fuel to each of the combustion cylinders. Referring to FIG. 2A, each of the passageways 27 may be throttled for improved performance. A port deactivation assembly 24 may be used that includes valves 26 arranged in each of the passageways 27. A linkage 28 is connected to each of the valves 26 and is manipulated by an actuator. The valves 26 are typically closed during idling conditions and are opened as the engine runs at higher speeds. A gasket 30 is arranged between the lower intake manifold 16 and the cylinder head.

Figure 2B:
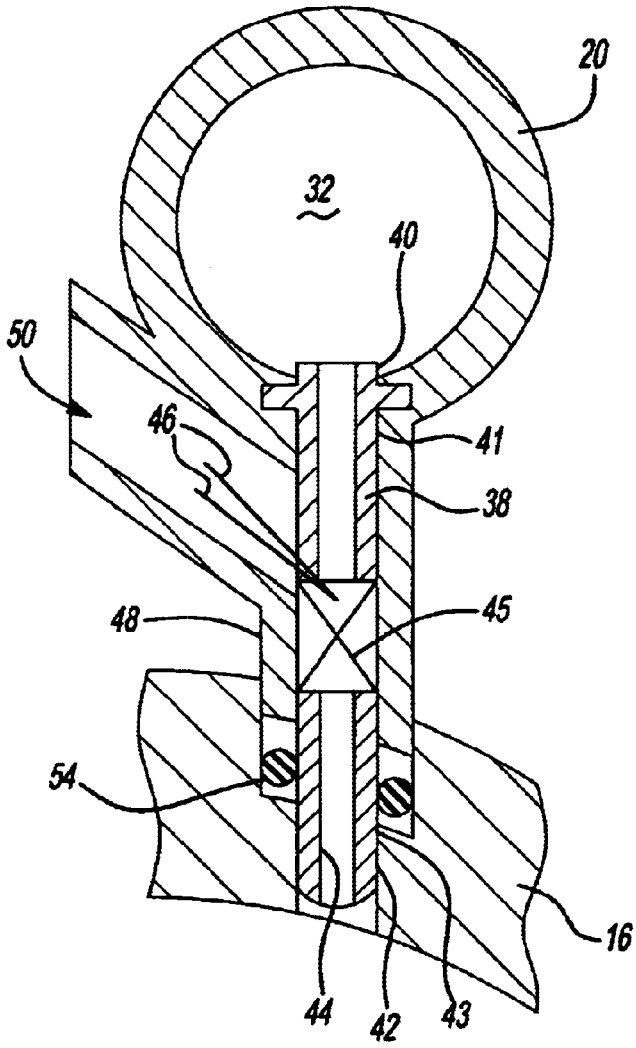
FIG. 2B is a cross sectional view of the figure rail, injector and lower intake manifold taken along lines 2B—2B of FIG. 2A.

Referring to FIGS. 2A and 2B, the fuel rail 20 include a fuel passage 32 having caps 34 enclosing the fuel passage 32. A fuel injector 36 includes an injector housing 38 having first 40 and second 42 portions opposite one another. An injector passage 44 extends between the first and second portions 40, 42. A valve 45 is arranged in the injector passage 44 and includes electrical contacts 46 that receive electrical power to actuate the valve 45 and deliver fuel to the cylinders from the fuel rail 20.

An integrated fuel rail 20 and fuel injector 36 is shown in FIG. 2B. The fuel rail 20 includes a first opening 41 receiving the first portion 40. A polymer layer 48 extends from the fuel rail 20 about the first portion 40 of the fuel injector 36 to create a seal between the fuel rail 20 and the first portion 40. In this manner, a separate seal is not necessary to prevent leakage of fuel. The polymer layer 48 may be molded over a fuel injector and separate fuel rail, or the polymer layer may form the fuel rail 20 and define the passageway 32, as shown in FIG. 2B.

The integrated fuel rail and injector may be inserted into a second opening 43 of a separate intake manifold and sealed thereto in a conventional manner utilizing a separate seal 54.

The integrated fuel rail and injector may include a cavity 50 receiving wires 51 connected to the electrical contacts 46 of the fuel injector 36. A plastic seal may be molded or inserted into the cavity 50 to enclose the wires 51 and protect the wires 51 and electrical contacts 46 from the outside environment, which is best shown in FIGS. 3 and 4.

Figure 3:
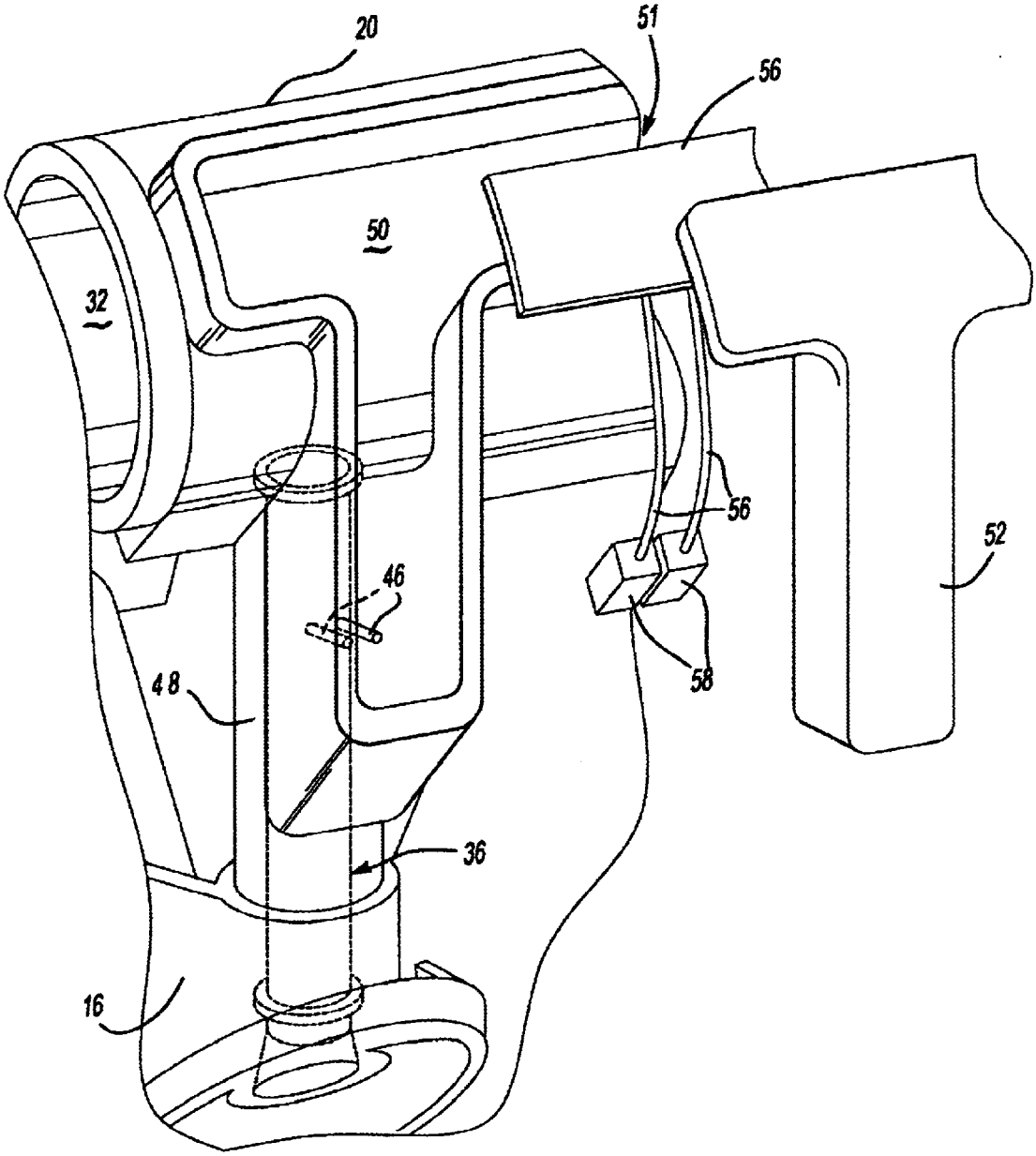
FIG. 3 is a perspective view an integrated fuel rail, fuel injector, and intake manifold including the injector wiring.

Referring to FIG. 3, the wires 51 may include a ribbon 56 having adjoining wires. A pair of leads 56 having individual connectors 58 may be connected to the electrical contacts 46 as shown in FIG. 3. The individual connector 58 can be smaller since they are not exposed. The fuel rail 20 and injector 36 may also be integrated into the intake manifold to provide a unitary structure. The polymer layer 48 may extend from the fuel 20 to the intake manifold 16 to at least partially, or preferably substantially, enclosed the fuel injector 36. As discussed above with respect to the fuel rail, the polymer layer 48 may extend about a separate intake manifold portion, or the polymer layer 48 may form the intake manifold portion 16.

Figure 4:
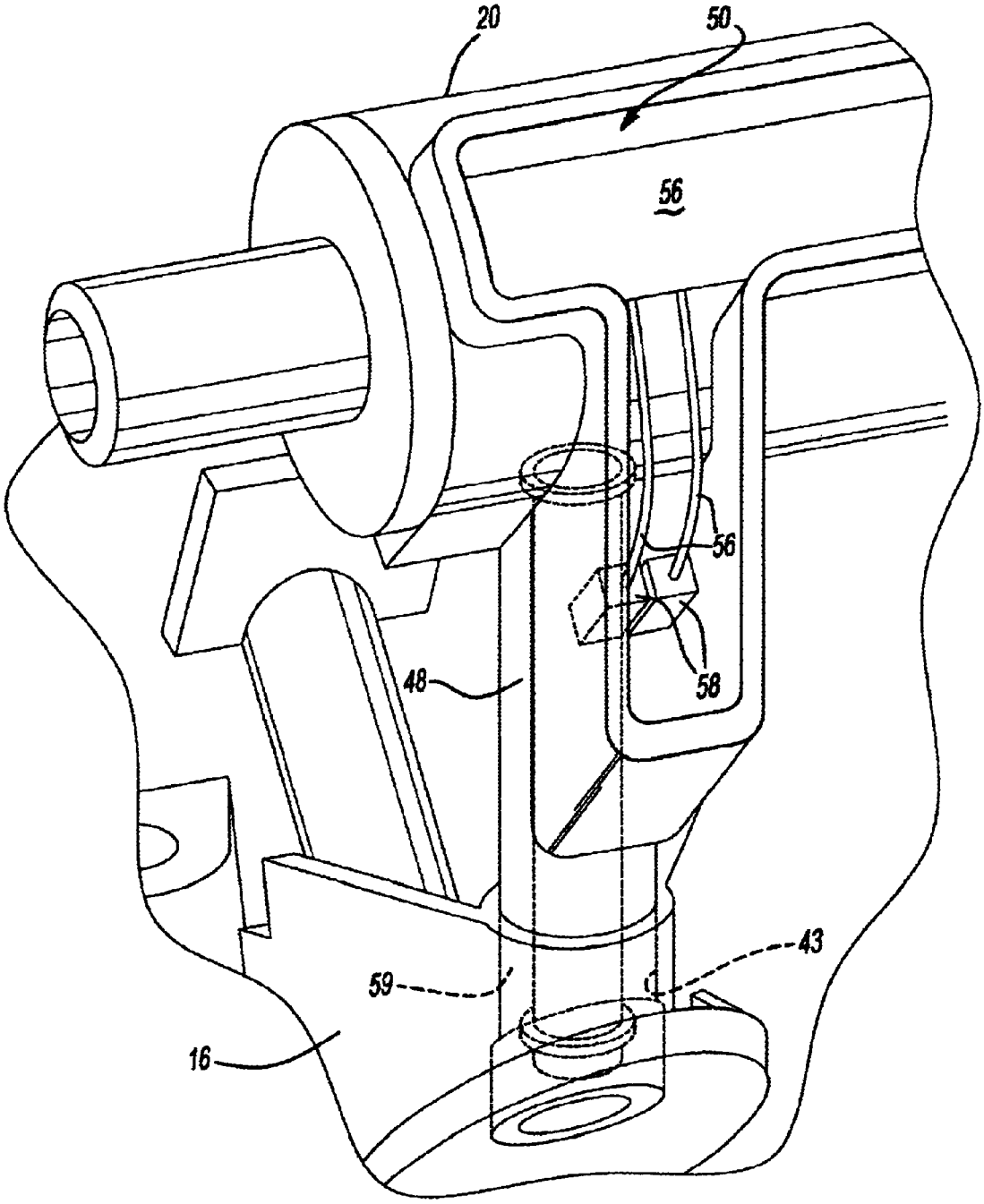
FIG. 4 is a perspective view of an integrated fuel rail and fuel injector with injector wiring inserted into an intake manifold.

FIG. 4 depicts an arrangement similar to FIG. 2B. However, the polymer layer 48 surrounds the fuel injector 36 to provide a fuel rail portion 59 that is inserted into the second opening 43 of a separate intake manifold 16. The fuel rail portion 59 may seal against the intake manifold 16 or a separate seal may be used therebetween.

Figure 5:
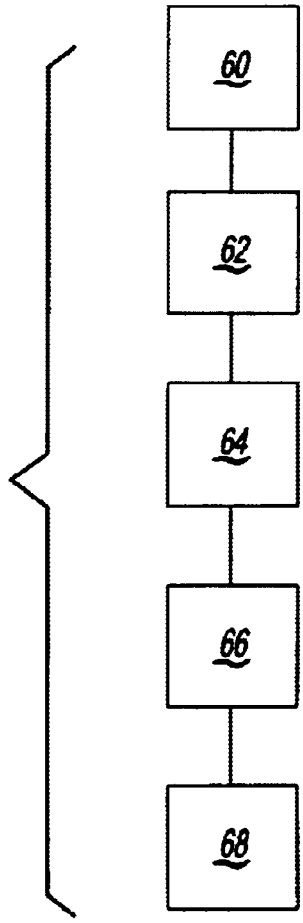
FIG. 5 is a flowchart depicting a process for forming the present invention fuel injection system.

A method for forming the present invention fuel injection system is depicted in FIG. 5. A fuel injector is provided, as depicted at block 60. A polymer material is molded about a portion of the fuel injector, as depicted by block 62. The polymer may be a polyamide or other material that is suitable for an environment having pressurized fuel. The polymer material must exhibit a suitable stability and permeation rate. The polymer material may form a portion of the fuel rail. The polymer material may be molded about another portion of the fuel injector, as indicated at block 64, and may form the intake manifold. A cavity may be formed in the fuel rail and injector wires may be inserted into the cavity, as indicated at block 66. The cavity is sealed, as indicated at block 68, by injecting or inserting a plastic or other suitable material to enclose the wires and protect them from the outside environment.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A fuel injection system for an internal combustion engine comprising:

a fuel injector having an injector housing with first and second opposing portions with an injector passe extending between said first and second portion; and a valve disposed in said injector passage for selectively permitting fuel to flow from said first portion to said second portion;

a fuel rail having a fuel passage having a first opening said first portion with said injector in fluid communication with said fuel passage;

an intake manifold having a second opening receiving said second portion, wherein said intake manifold includes an upper portion having a plenum terminating in a plurality of apertures, and a lower portion secured to said upper portion with said lower portion having a plurality of individual passageways with said each of said plurality of apertures in fluid communication with a corresponding one of said plurality of passageways and said second portion of said injector in one of said passage; and a polymer layer extending from said fuel rail and said intake manifold about at least a portion of said fuel injector sealing said first and second portions respectively to said fuel rail and said intake manifold for preventing fuel from leaking from the fuel injection system.

2. The system according to claim 1, wherein said layer forms said fuel rail and defines said fuel passage.

3. The system according to claim 1, wherein said layer forms said intake manifold.

4. A fuel injection system for an internal combustion engine comprising:

a plurality of fuel injectors with each having an injector housing with first and second opposing portions with an injector passage extending between said first and second portions, and a valve disposed in said injector passage for selectively permitting fuel to flow from said first portion to said second portion;

a fuel rail having a fuel passage having a first opening receiving said first portion with said injector passage in fluid communication with said fuel passage, wherein said fuel rail includes a cavity extending between at least two of said injectors and said injectors include electrical contacts extending into said cavity, wires disposed with said cavity connected to said contacts;

a seal enclosing said wires within said cavity;

an intake manifold having a second opening receiving said second portion; and a polymer layer extending from said fuel rail and said intake manifold about at least a portion of said fuel injector sealing said first and second portions respectively to said fuel rail and said intake manifold for preventing fuel from leaking from the fuel injection system.

5. The system according to claim 4, wherein seal is plastic molded into said cavity.

6. The system according to claim 4, wherein said wires is a ribbon including a plurality of wires extending from said ribbon for connection to said plurality of injectors.

7. The system according to claim 4, wherein said contacts includes first and second contacts and said wires includes first and second wires respectively including first and second individual connectors independent of one another respectively connected to said first and second contacts.

8. The system according to claim 1, wherein said layer is unitary extending from said fuel rail to said intake manifold substantially enclosing said fuel injector and interconnecting said fuel rail with said intake manifold.

9. A fuel injection system for an internal combustion engine comprising:

a fuel injector having an injector housing with first and second opposing portions with an injector passage extending between said first and second portions, and a valve disposed in said injector for selectively permitting fuel to flow from said first portion to said second portion;

a fuel rail having a fuel passage having a first opening receiving said first portion with said injector passage in fluid communication with said fuel passage;

a polymer layer extending from said fuel rail about at least a portion of said fuel injector sealingly said first portion to said fuel rail for preventing fuel from leaking from the fuel injection system;

an intake manifold having a passageway with a second opening removably receiving said second portion with sad injector passage in fluid communication with said fuel passage; and a seal arranged between said fuel rail and said second opening.

10. A fuel injection system for an internal combustion engine comprising a fuel injector having an injector housing with first and second opposing portions with an injector passage extending between said first and second portions, and a valve disposed in said injector passage for selectively permitting fuel to flow from said first portion to said second portion;

a fuel rail having a fuel passage having a first opening receiving said first portion with said injector passage in fluid communication with said fuel passage;

a polymer layer extending from said fuel rail about at least a portion of said fuel injector sealing said fist portion to said fuel rail for preventing fuel from leaking from the fuel injection system a structure defining an intake manifold having a second opening receiving said second portion, said polymer layer extending from said rail manifold about of least a portion of said fuel injector sealing said second portion to said intake manifold for preventing fuel from leaking from the fuel system.

11. The system according to claim 9, wherein said layer forms said fuel rail and defines said fuel passage.

12. The system according to claim 9, wherein fuel rail includes a cavity and said injector includes electrical contacts extending into said cavity, said system further including wires disposed within said cavity connected to said contacts and a seal enclosing said wires within said cavity.

13. The system according to claim 12, wherein seal is plastic molded into said cavity.

14. The system according to claim 12, wherein said wires is a ribbon including a plurality of wires adjoining one another.

15. The system according to claim 12, wherein said contacts includes first and second contacts and said wires includes first and second wires respectively including first and second individual connectors independent of one another respectively connected to said first and second contacts.

16. A method of forming a fuel injection system comprising the steps of:

a) providing at least two fuel injectors with electrical contacts;

b) molding a polymer material about a portion of the fuel injector;

c) forming a fuel rail having a cavity extending between the injectors receiving the electrical contacts with the polymer material; and d) molding the polymer material about another portion of the fuel injector.

17. The method according to claim 16, further including step d) arranging wires in the cavity and connecting the wires to the electrical contacts.

18. The method according to claim 17, further including step e) molding a plastic into the cavity and enclosing the wires.

19. The method according to claim 16, further including step c) forming an intake manifold with the polymer material.

* * * * *